US011905959B2

(12) United States Patent
Tsuchida

(10) Patent No.: US 11,905,959 B2
(45) Date of Patent: Feb. 20, 2024

(54) ELECTRIC BLOWER, VACUUM CLEANER, AND HAND DRYING DEVICE

(71) Applicant: Mitsubishi Electric Corporation, Tokyo (JP)

(72) Inventor: Kazuchika Tsuchida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1053 days.

(21) Appl. No.: 16/614,891

(22) PCT Filed: Aug. 4, 2017

(86) PCT No.: PCT/JP2017/028347

§ 371 (c)(1),
(2) Date: Nov. 19, 2019

(87) PCT Pub. No.: WO2019/026269

PCT Pub. Date: Feb. 7, 2019

(65) Prior Publication Data

US 2020/0208641 A1 Jul. 2, 2020

(51) Int. Cl.

| | |
|---|---|
| ***F04D 25/06*** | (2006.01) |
| ***A47K 10/48*** | (2006.01) |
| ***F04D 25/16*** | (2006.01) |
| ***F04D 29/043*** | (2006.01) |
| ***F04D 29/046*** | (2006.01) |
| ***F04D 29/52*** | (2006.01) |
| ***F04D 29/66*** | (2006.01) |

(52) U.S. Cl.
CPC ..... *F04D 25/06* (2013.01); *A47K 10/48* (2013.01); *F04D 25/166* (2013.01); *F04D 29/043* (2013.01); *F04D 29/046* (2013.01); *F04D 29/522* (2013.01); *F04D 29/66* (2013.01)

(58) Field of Classification Search
CPC ..... A47K 10/48; F04D 25/06; F04D 25/166; F04D 29/043; F04D 29/046; F04D 29/522; F04D 29/66
USPC ..... 34/202
See application file for complete search history.

(56) References Cited

U.S. PATENT DOCUMENTS 1,476,776 A * 12/1923 Stamm ..... H02K 9/06 417/350
3,836,291 A * 9/1974 Bottcher ..... H02K 5/12 415/55.1

(Continued)

FOREIGN PATENT DOCUMENTS

CN 105736429 A 7/2016
DE 10 2007 014 466 A1 10/2007

(Continued)

OTHER PUBLICATIONS

Office Action dated May 19, 2020 issued in corresponding JP patent application No. 2019-533853 (and English translation).

(Continued)

*Primary Examiner* — Stephen M Gravini
(74) *Attorney, Agent, or Firm* — POSZ LAW GROUP, PLC

(57) ABSTRACT

An electric blower includes a motor, a fan to generate a first air current, a fan to generate a second air current, and a housing. The first air current and the second air current are exhausted from the housing in opposite directions to each other in the axial direction.

11 Claims, 10 Drawing Sheets

(56) References Cited

U.S. PATENT DOCUMENTS

| | | | | |
|---|---|---|---|---|
| 6,398,517 | B1 * | 6/2002 | Choi | F04D 29/057 417/423.12 |
| 10,947,994 | B2 * | 3/2021 | Tsuchida | B25F 5/008 |
| 2004/0213687 | A1 | 10/2004 | Cheng | |
| 2007/0114870 | A1 * | 5/2007 | Lee | H02K 1/22 310/44 |
| 2008/0304986 | A1 | 12/2008 | Kenyon et al. | |
| 2013/0223997 | A1 | 8/2013 | Childe et al. | |
| 2019/0136872 | A1 | 5/2019 | Tsuchida et al. | |
| 2020/0208641 | A1 * | 7/2020 | Tsuchida | F04D 25/166 |
| 2021/0050762 | A1 * | 2/2021 | Tsuchida | F04D 25/082 |

FOREIGN PATENT DOCUMENTS

| | | | |
|---|---|---|---|
| JP | S53-091409 | A | 8/1978 |
| JP | S58-035699 | U | 3/1983 |
| JP | S58-217799 | A | 12/1983 |
| JP | S59-127898 | U | 8/1984 |
| JP | S61-138036 | A | 6/1986 |
| JP | H04-019700 | U | 2/1992 |
| JP | H04-061452 | U | 5/1992 |
| JP | H11-230095 | A | 8/1999 |
| JP | 2001-263297 | A | 9/2001 |
| JP | 2001-271794 | A | 10/2001 |
| JP | 2002-064956 | A | 2/2002 |
| JP | 2013-044435 | A | 3/2013 |
| JP | 2013-072290 | A | 4/2013 |
| JP | 2015-190459 | A | 11/2015 |
| JP | 2016-059276 | A | 4/2016 |
| JP | 2017-032134 | A | 2/2017 |
| JP | WO2018011917 | A1 * | 8/2018 |
| WO | 2018/011917 | A1 | 1/2018 |
| WO | WO-2018011917 | A1 * | 1/2018 ..... B25F 5/008 |

OTHER PUBLICATIONS

International Search Report of the International Searching Authority dated Oct. 3, 2017 for the corresponding International application No. PCT/JP2017/028347 (and English translation).

Office Action dated Mar. 1, 2022 in connection with counterpart European Patent Application No. 17 920 434.2.

Extended European Search Report dated Jul. 10, 2020 issued in corresponding EP patent application No. 17920434.2.

Office Action dated Aug. 11, 2020 issued in corresponding JP patent application No. 2019-533853 (and English translation).

* cited by examiner

ELECTRIC BLOWER, VACUUM CLEANER, AND HAND DRYING DEVICE

CROSS REFERENCE TO RELATED APPLICATION

This application is a U.S. national stage application of International Patent Application No. PCT/JP2017/028347 filed on Aug. 4, 2017, the disclosure of which is incorporated herein by reference.

TECHNICAL FIELD

The present invention relates to an electric blower including a motor.

BACKGROUND

Generally, in a motor used for an electric blower, a shaft fixed to a rotor, and a bearing to rotatably support the shaft are used. When a bearing including balls, an inner ring, and an outer ring is used, the outer ring is fixed to a frame, and the inner ring rotatably supports the shaft (see, for example, patent reference 1).

PATENT REFERENCE

Patent Reference 1: Japanese Patent Application Publication No. 2013-44435

However, in the electric blower, during driving of the motor, when air flows into the electric blower from a suction port, a thrust load is applied to the motor due to the difference in pressure between the suction port side and the exhaust port side. When, for example, a high thrust load is applied to the bearing, considerable friction occurs in the bearing, so the life of the bearing shortens. As a result, there is a problem in that the life of the electric blower shortens.

SUMMARY

It is an object of the present invention to reduce the thrust load applied to the motor and enhance the aerodynamic efficiency in the electric blower.

An electric blower according to an aspect of the present invention includes a motor, a first fan provided on one end side of the motor in an axial direction and to generate a first air current, a second fan provided opposite to the first fan in the axial direction and to generate a second air current, and a housing covering the motor, the first fan, and the second fan, wherein the housing includes a first exhaust port and a second exhaust port that are formed on both sides in the axial direction, and the first air current and the second air current are exhausted from the first exhaust port and the second exhaust port in opposite directions to each other in the axial direction respectively.

According to the present invention, it is possible to reduce the thrust load applied to the motor and enhance the aerodynamic efficiency in the electric blower.

DETAILED DESCRIPTION

Embodiment 1

Figure 1:
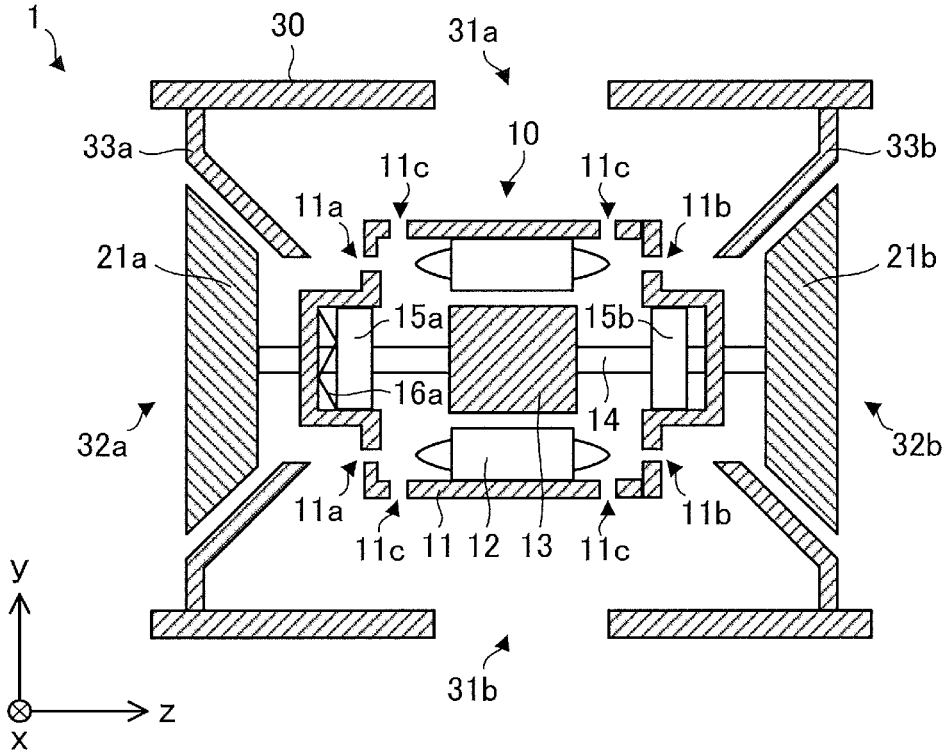
FIG. 1 is a sectional view schematically illustrating a structure of an electric blower according to Embodiment 1 of the present invention.
Figure 2:
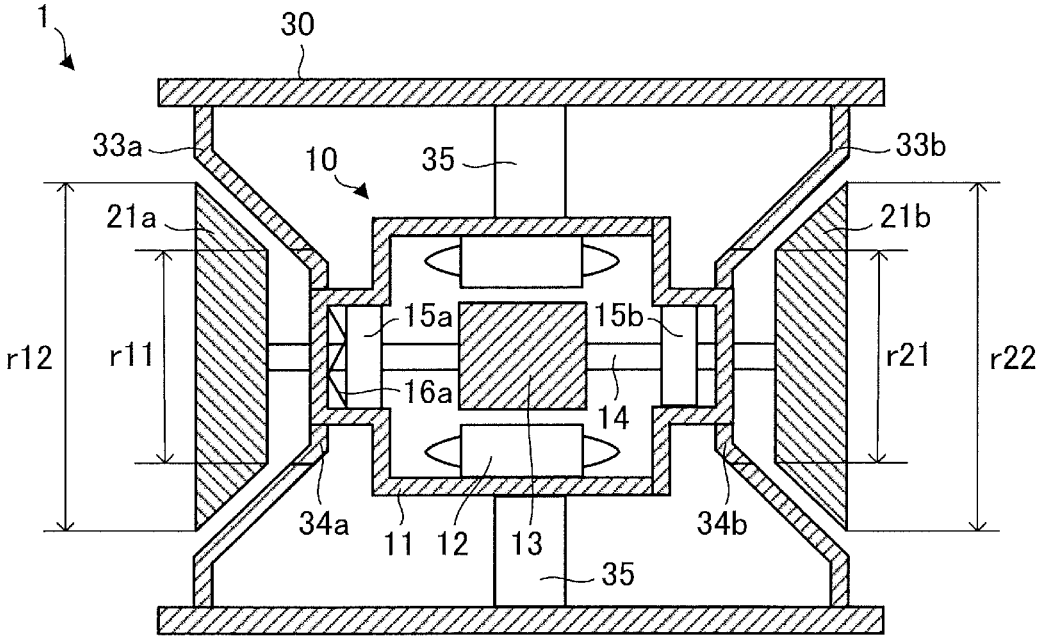
FIG. 2 is a sectional view schematically illustrating the structure of the electric blower according to Embodiment 1.

FIGS. 1 and 2 are sectional views schematically illustrating a structure of an electric blower 1 according to Embodiment 1 of the present invention. FIG. 2 is a diagram illustrating the electric blower 1 illustrated in FIG. 1 in a state in which it is rotated in a circumferential direction. The "circumferential direction" means, for example, the rotation direction of a fan 21*a* or 21*b*. A "radial direction" means the radial direction of a motor 10 and a rotor 13.

In an x-y-z orthogonal coordinate system illustrated in FIG. 1, the z-direction (z-axis) indicates a direction (to be referred to as the "axial direction" hereinafter) parallel to the axis (the center of rotation of the rotor 13) of a shaft 14 of the motor 10, the x-direction (x-axis) indicates a direction perpendicular to the z-direction (z-axis), and the y-direction indicates a direction perpendicular to both the z-axis direction and the x-axis direction.

The electric blower 1 includes the motor 10, the fan 21*a* (first fan), the fan 21*b* (second fan), and a housing 30.

The motor 10 is, for example, a permanent magnet synchronous motor. As the motor 10, however, a motor other than the permanent magnet synchronous motor, such as a commutator motor, may be used.

The motor 10 includes a motor housing 11 (also called a motor frame), a stator 12 fixed to the motor housing 11, a rotor 13 disposed inside the stator 12, a shaft 14 fixed to the rotor 13, a bearing 15*a* (first bearing), a bearing 15*b* (second bearing), and a preload spring 16*a*.

The rotor 13 rotates the fans 21*a* and 21*b*. The shaft 14 is fitted into the bearings 15*a* and 15*b* by press fitting.

Figure 3:
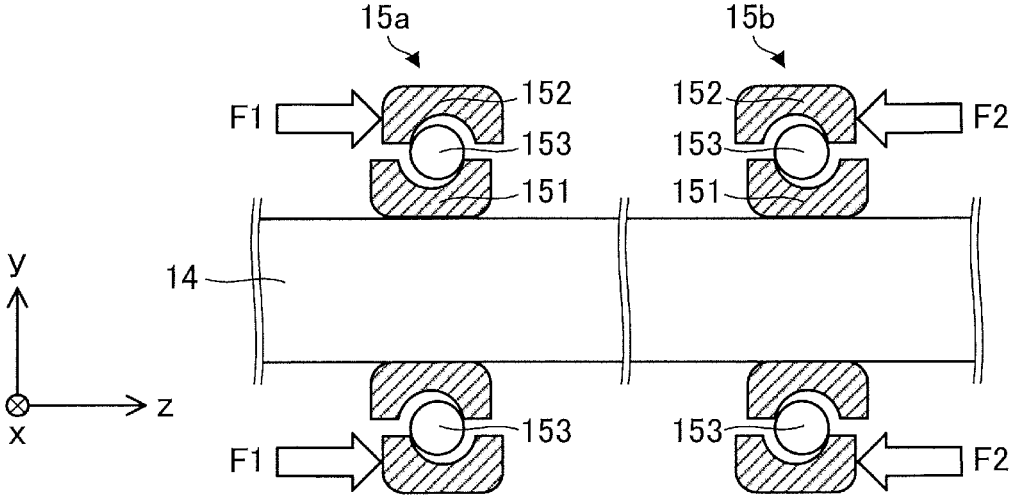
FIG. 3 is a diagram illustrating a state of bearings while a motor is stopped.

FIG. 3 is a diagram illustrating a state of the bearings 15*a* and 15*b* while the motor 10 is stopped.

Each of the bearings 15*a* and 15*b* includes an inner ring 151, an outer ring 152, and a plurality of balls 153 provided between the inner ring 151 and the outer ring 152. The bearings 15*a* and 15*b* are inserted inside the motor housing 11. The inner ring 151 is fixed to the shaft 14. With this arrangement, the bearings 15*a* and 15*b* rotatably support the shaft 14.

The preload spring 16*a* applies a load (a force F1 illustrated in FIG. 3) in the axial direction (the +z-direction in FIG. 3) to the bearing 15*a* (more specifically, the outer ring 152 of the bearing 15*a*). In other words, FIG. 3 illustrates a state in which the outer ring 152 of the bearing 15*a* is pressed in the axial direction (the +z-direction in FIG. 3) by the preload spring 16*a*. With this arrangement, the bearing 15*b* (more specifically, the outer ring 152 of the bearing 15*b*) receives a force F2 in the axial direction (the −z-direction in FIG. 3). The force F2 acts as a load from the motor housing 11 generated by a reaction to the force F1.

The motor housing 11 covers the stator 12 and the rotor 13. The motor housing 11 includes holes 11*a*, 11*b*, and 11*c*. In this Embodiment, a plurality of holes 11*a* and a plurality of holes lib are formed on both sides of the motor housing 11 in the axial direction. Each hole 11*a* and each hole lib pass through the motor housing 11 in the axial direction.

In this Embodiment, furthermore, a plurality of holes 11*c* are formed on both sides of the motor housing 11 in the radial direction. Each hole 11*c* passes through the motor housing 11 in the radial direction. This makes it possible to pass an air current in the axial direction from the radial direction in the motor 10 and to efficiently cool the electric blower 1.

The housing 30 covers the motor 10 and the fans 21*a* and 21*b*. The housing 30 includes a suction port 31*a* (first suction port) as an inlet for an air current, a suction port 31*b* (second suction port) as another inlet for an air current, an exhaust port 32*a* (first exhaust port) as an outlet for the air current, an exhaust port 32*b* (second exhaust port) as another outlet for the air current, a fan cover 33*a* (first fan cover) covering the fan 21*a*, a fan cover 33*b* (second fan cover) covering the fan 21*b*, a fan cover support portion 34*a* to support the fan cover 33*a*, a fan cover support portion 34*b* to support the fan cover 33*b*, and a frame support portion 35 to support the motor 10 (more specifically, the motor housing 11).

The fan cover 33*a* is supported by the fan cover support portion 34*a* and the fan cover support portion 34*a* is fixed to the motor housing 11. The fan cover 33*b* is supported by the fan cover support portion 34*b* and the fan cover support portion 34*b* is fixed to the motor housing 11. This makes it possible to maintain the positions and the rigidity of the fan covers 33*a* and 33*b*.

Figure 4A:
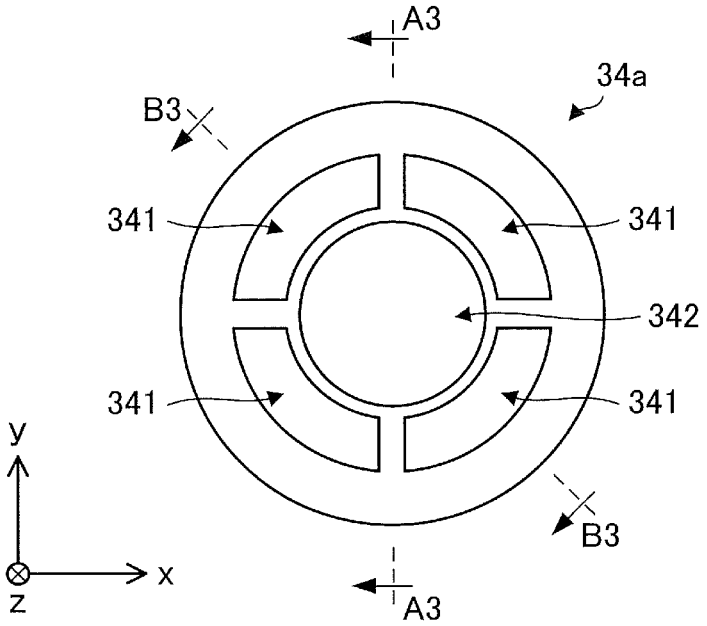
FIG. 4*a* is a front view schematically illustrating a structure of a fan cover support portion.
Figure 4B:
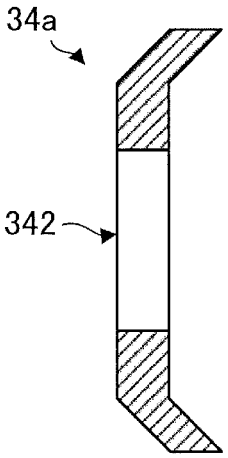
FIG. 4*b* is a sectional view taken along a line A3-A3 in FIG. 4*a*.
Figure 4C:
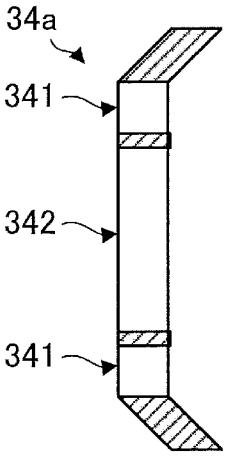
FIG. 4*c* is a sectional view taken along a line B3-B3 in FIG. 4*a*.

FIG. 4*a* is a front view schematically illustrating a structure of the fan cover support portion 34*a*, FIG. 4*b* is a sectional view taken along a line A3-A3 in FIG. 4*a*, and FIG. 4*c* is a sectional view taken along a line B3-B3 in FIG. 4*a*.

The fan cover support portion 34*a* includes a plurality of opening portions 341 and a frame insertion portion 342. Each opening portion 341 is used as an air path through which an air current passes. The frame insertion portion 342 is fixed to the motor housing 11. With this arrangement, the fan cover support portion 34*a* is fixed to the motor housing 11. The fan cover support portion 34*b* has the same structure as that of the fan cover support portion 34*a* illustrated in FIGS. 4*a* to 4*c*.

The suction ports 31*a* and 31*b* are formed in the housing 30 to be located between the fan 21*a* and the fan 21*b* in the axial direction. This makes it possible to shorten the air path in the housing 30 and to downsize the electric blower 1.

The exhaust ports 32*a* and 32*b* are formed on both sides of the housing 30 in the axial direction.

The fans 21*a* and 21*b* rotate in accordance with rotation of the motor 10 (more specifically, the rotor 13 and the shaft 14). Accordingly, the fan 21*a* generates a first air current (to be simply referred to as an "air current" hereinafter), and the fan 21*b* generates a second air current (to be simply referred to as an "air current" hereinafter). The fan 21*a* is provided on one end side of the motor 10 in the axial direction, and the fan 21*b* is provided opposite to the fan 21*a* in the axial direction. More specifically, the fans 21*a* and 21*b* are fixed to the shaft 14 so that the air current generated by the fan 21*a* and the air current generated by the fan 21*b* flow in opposite directions to each other in the axial direction.

A gap through which air passes is formed between the fan 21*a* and the fan cover 33*a*. Similarly, a gap through which air passes is formed between the fan 21*b* and the fan cover 33*b*.

In the fan 21*a*, the inner diameter r11 is smaller than the outer diameter r12. In the fan 21*a*, the inner diameter r11 is the diameter of the inner end of the fan 21*a* in the axial direction. In the fan 21*a*, the outer diameter r12 is the diameter of the outer end of the fan 21*a* in the axial direction. Therefore, on the side of the fan 21*a*, during driving of the motor 10, air flows outwards from the inside in the axial direction.

Similarly, in the fan 21*b*, the inner diameter r21 is smaller than the outer diameter r22. In the fan 21*b*, the inner diameter r21 is the diameter of the inner end of the fan 21*b* in the axial direction. In the fan 21*b*, the outer diameter r22 is the diameter of the outer end of the fan 21*b* in the axial direction. Therefore, on the side of the fan 21*b*, during driving of the motor 10, air flows outwards from the inside in the axial direction.

In this Embodiment, the inner diameter r11 is equal to the inner diameter r21, and the outer diameter r12 is equal to the outer diameter r22. With this configuration, the air current generated by the fan 21*a* and the air current generated by the fan 21*b* are exhausted outside the electric blower 1 from the housing 30 (more specifically, the exhaust ports 32*a* and 32*b*) in opposite directions to each other in the axial direction.

The fans 21*a* and 21*b* are implemented as, for example, centrifugal fans (for example, turbofans) or mixed-flow fans. The centrifugal fan is a fan to blow air in the centrifugal direction. The turbofan is a fan equipped with backswept blades. The mixed-flow fan is a fan to generate an air current in a direction inclined with respect to the axis of rotation of the fan. However, the fans 21*a* and 21*b* may be fans other than the centrifugal fans and the turbofans.

Figure 5:
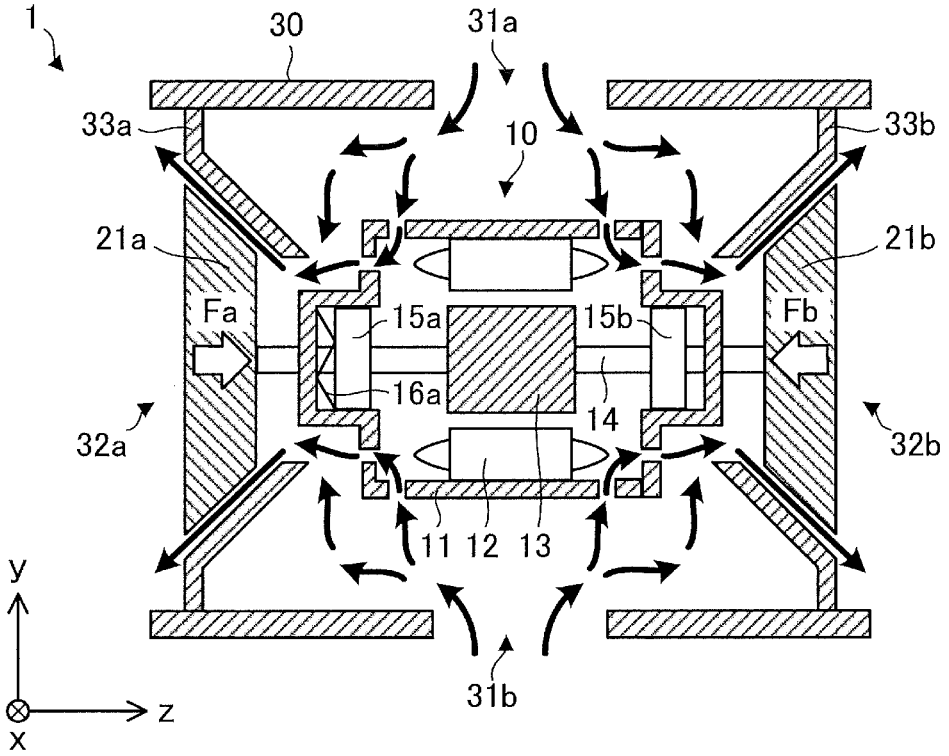
FIG. 5 is a diagram illustrating flow of air in the electric blower during driving of the electric blower.

FIG. 5 is a diagram illustrating flow of air in the electric blower 1 during driving of the electric blower 1.

As illustrated in FIG. 5, during driving of the motor 10, the rotor 13 and the shaft 14 rotate, and the fans 21*a* and 21*b*, in turn, rotate. Accordingly, the fans 21*a* and 21*b* generate air currents, and air flows into the electric blower 1 (more specifically, the housing 30) from the suction ports 31*a* and 31*b*.

Since the holes 11*c* are formed in the motor housing 11, the air partially flows into the motor 10 (more specifically, the motor housing 11). In the example illustrated in FIG. 5, the air flows into the motor 10 from the holes 11*c* (see FIG. 1) and is exhausted outside the motor 10 from the holes 11*a* and 11*b* (see FIG. 1).

The air in the electric blower 1 is exhausted outside the electric blower 1 from the exhaust ports 32*a* and 32*b*.

As illustrated in FIG. 5, on the side of the fan 21*a*, during driving of the motor 10, when air flows into the electric blower 1 from the suction ports 31*a* and 31*b*, a difference in pressure occurs between the side of the suction ports 31*a* and 31*b* and the side of the exhaust port 32*a*. This generates thrust Fa on the fan 21*a* and the shaft 14 of the motor 10.

Similarly, as illustrated in FIG. 5, on the side of the fan 21*b*, during driving of the motor 10, when air flows into the electric blower 1 from the suction ports 31*a* and 31*b*, a difference in pressure occurs between the side of the suction ports 31*a* and 31*b* and the side of the exhaust port 32*b*. This generates thrust Fb on the fan 21*b* and the shaft 14 of the motor 10.

The thrust Fa and Fb act in opposite directions to each other in the axial direction. In this Embodiment, the magnitude of the thrust Fa and Fb are equal to each other. Therefore, since the thrust Fa and Fb cancel each other, the thrust load applied to the motor 10 (more specifically, the bearings 15*a* and 15*b*) is reduced. This makes it possible to reduce the loads acting between the balls and the inner rings and the loads acting between the balls and the outer rings in the bearings 15*a* and 15*b* and therefore the lives of the bearings 15*a* and 15*b* can be prolonged.

Figure 6:
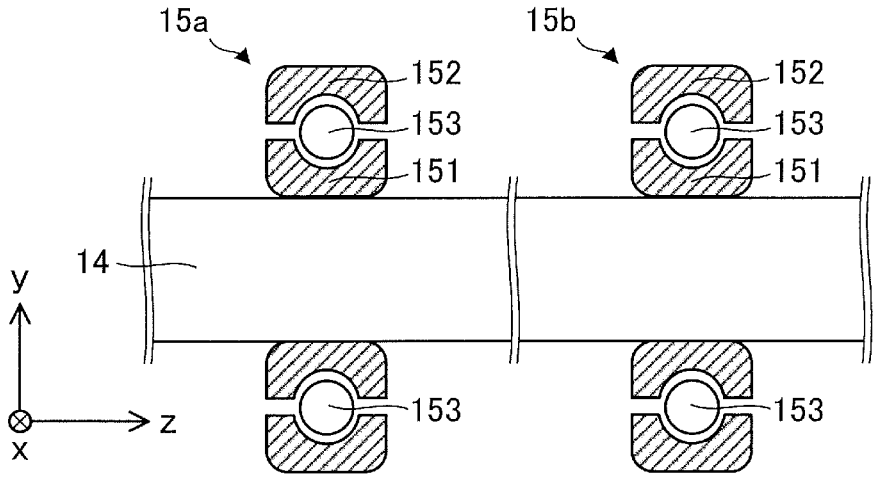
FIG. 6 is a sectional view illustrating a state of bearings in an electric blower according to Comparative Example 1.

FIG. 6 is a sectional view illustrating the state of bearings 15*a* and 15*b* in an electric blower according to Comparative Example 1. The electric blower according to Comparative Example 1 does not include the preload spring 16*a*. Therefore, in the example illustrated in FIG. 6, the bearing 15*a* is not pressed by the preload spring 16*a*.

As illustrated in FIG. 6, a bearing generally has a clearance between an inner ring and balls and a clearance between an outer ring and the balls. Therefore, during rotation of a shaft, the position of the balls, the inner ring, or the outer ring may shift in the axial direction. The higher the rotational speed of a motor, the more likely collisions between the balls and the inner ring and collisions between the balls and the outer ring are to occur, and these collisions may result in shortening life of the bearing.

In this Embodiment, the preload spring 16*a* applies a load (the force F1 illustrated in FIG. 3) in the axial direction (the +z-direction in FIG. 3) to the bearing 15*a* (more specifically, the outer ring 152 of the bearing 15*a*). This makes it possible to maintain certain clearance between the balls 153 and the inner ring 151 and certain clearance between the balls 153 and the outer ring 152, as illustrated in FIG. 3, and, in turn, to prevent collision between the balls and the inner ring and collision between the balls and the outer ring. As a result, the lives of the bearings 15*a* and 15*b* can be prolonged.

Figure 7:
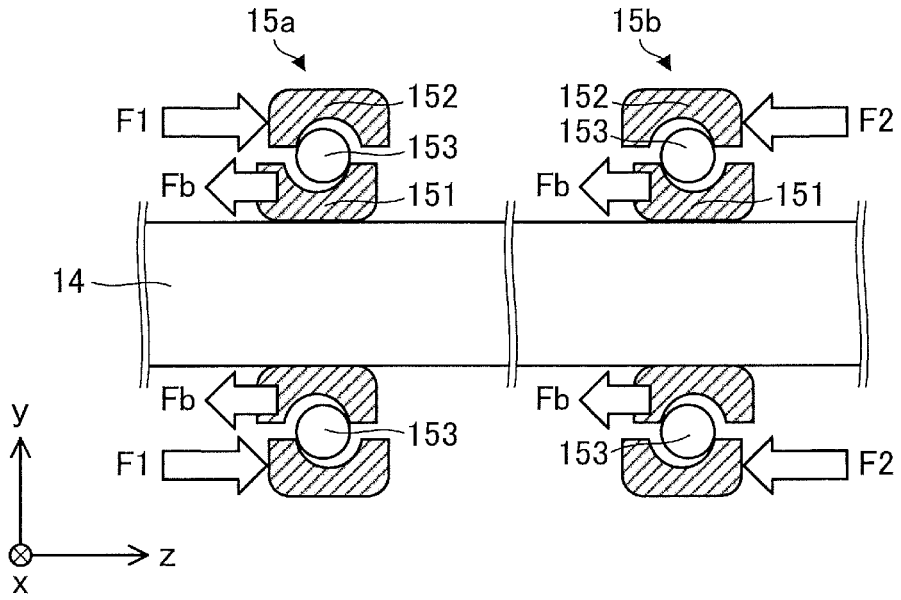
FIG. 7 is a sectional view illustrating a state of bearings in a motor for an electric blower according to Comparative Example 2, during driving of the motor.

FIG. 7 is a sectional view illustrating the state of bearings 15*a* and 15*b* in a motor for an electric blower according to Comparative Example 2, during driving of the motor.

The motor according to Comparative Example 2 includes a fan 21*b* and does not includes a fan 21*a*. Therefore, in the example illustrated in FIG. 7, thrust Fb is generated on a shaft 14 of a motor 10, and no thrust Fa is generated on the shaft 14.

In the example illustrated in FIG. 7, during driving of the motor 10, the thrust Fb acts on an inner ring 151 of the bearing 15*a* and an inner ring 151 of the bearing 15*b* through the shaft 14. Therefore, during driving of the motor 10, not only a force F1 or F2 but also the thrust Fb is applied to balls 153 of the bearings 15*a* and 15*b*. This increases the thrust load acting on the contact portions between the inner ring 151 and the balls 153 and the contact portions between an outer ring 152 and the balls 153 and thus the load applied to the bearings 15*a* and 15*b* increases.

In contrast to this, in this Embodiment, the fans 21*a* and 21*b* are provided on both sides of the shaft 14 in the axial direction and fixed to the shaft 14 so that an air current generated by the fan 21*a* and an air current generated by the fan 21*b* flow in opposite directions to each other in the axial direction. Therefore, the thrust Fa and Fb generated on the electric blower 1 act in opposite directions to each other in the axial direction. Since the thrust Fa and Fb cancel each other, the thrust load applied to the bearings 15*a* and 15*b* is reduced. As a result, it is possible to maintain certain clearance between the balls 153 and the inner ring 151 and certain clearance between the balls 153 and the outer ring 152 with appropriate force (that is, the force F1 and F2), as illustrated in FIG. 3, and to prevent collisions between the balls and the inner ring and collisions between the balls and the outer ring. It is, therefore, possible to prolong the lives of the bearings 15*a* and 15*b*.

Figure 8:
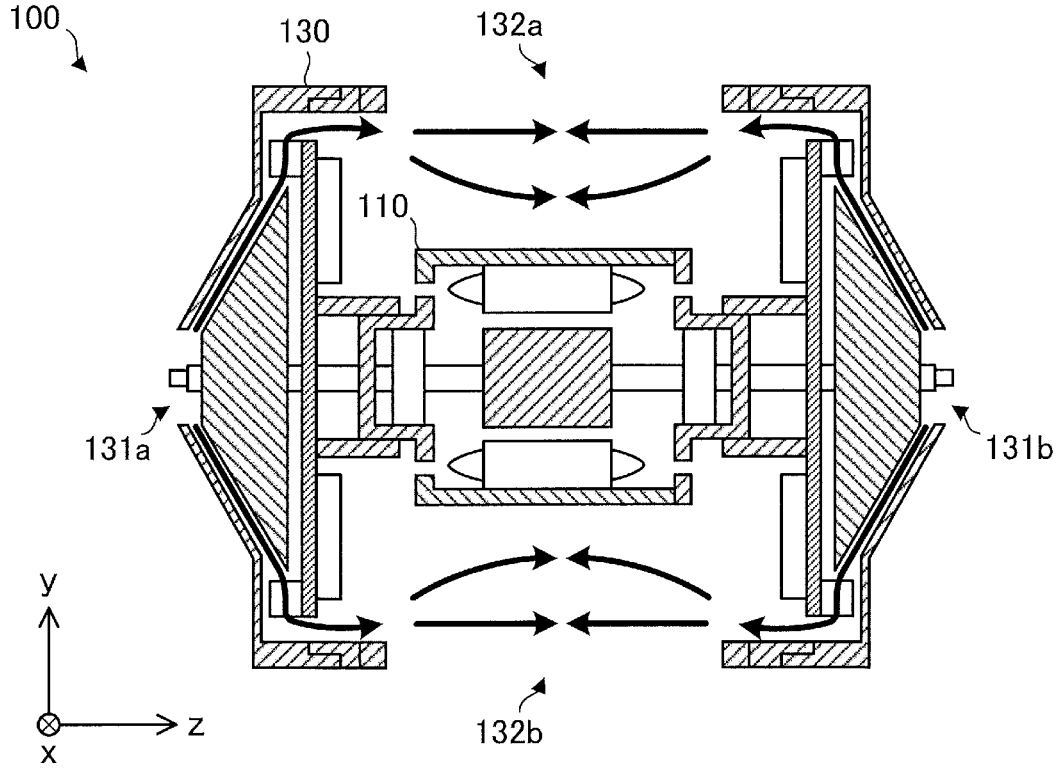
FIG. 8 is a sectional view schematically illustrating a structure of an electric blower according to Comparative Example 3.

FIG. 8 is a sectional view schematically illustrating a structure of an electric blower 100 according to Comparative Example 3.

In the electric blower 100 according to Comparative Example 3, with regard to fans, the diameter of the inner end is larger than the diameter of the outer end of each fan in the axial direction. In this case, air flows into the electric blower 100 from both sides in the axial direction. Therefore, in the electric blower 100 according to Comparative Example 3, suction ports 131*a* and 131*b* are provided on both sides of the electric blower in the axial direction, and exhaust ports 132*a* and 132*b* are formed in a housing 130 to be located in the middle of the electric blower 100 in the axial direction. In this case, air flowing into the electric blower 100 from one end side (for example, the suction port 131*a*) of the electric blower 100 in the axial direction collides with air flowing into the electric blower 100 from the other end side (for example, the suction port 131*b*), and this degrades the aerodynamic efficiency.

In contrast to this, in the electric blower 1 according to this Embodiment, the suction ports 31*a* and 31*b* are formed in the housing 30 to be located in the middle of the electric blower 1 in the axial direction, and the exhaust ports 32*a* and 32*b* are provided on both sides of the electric blower 1 in the axial direction. This makes it possible to prevent air flowing into the electric blower 1 from the suction port 31*a* from colliding with air flowing into the electric blower 1 from the suction port 31*b*. As a result, the aerodynamic efficiency of the electric blower 1 can be enhanced.

The electric blower 100 according to Comparative Example 3 includes no hole passing through a motor housing in the radial direction. Therefore, in the electric blower 100 according to Comparative Example 3, air can hardly pass through a motor 110.

In contrast to this, the electric blower 1 according to this Embodiment includes a plurality of holes 11*c* passing through the motor housing 11 in the radial direction. With this configuration, air flowing into the motor 10 from the holes 11*c* (see FIG. 1) is efficiently exhausted outside the motor 10 from the holes 11*a* and 11*b* (see FIG. 1), as illustrated in FIG. 5. As a result, cooling of the motor 10 can be accelerated.

Modification 1

Figure 9:
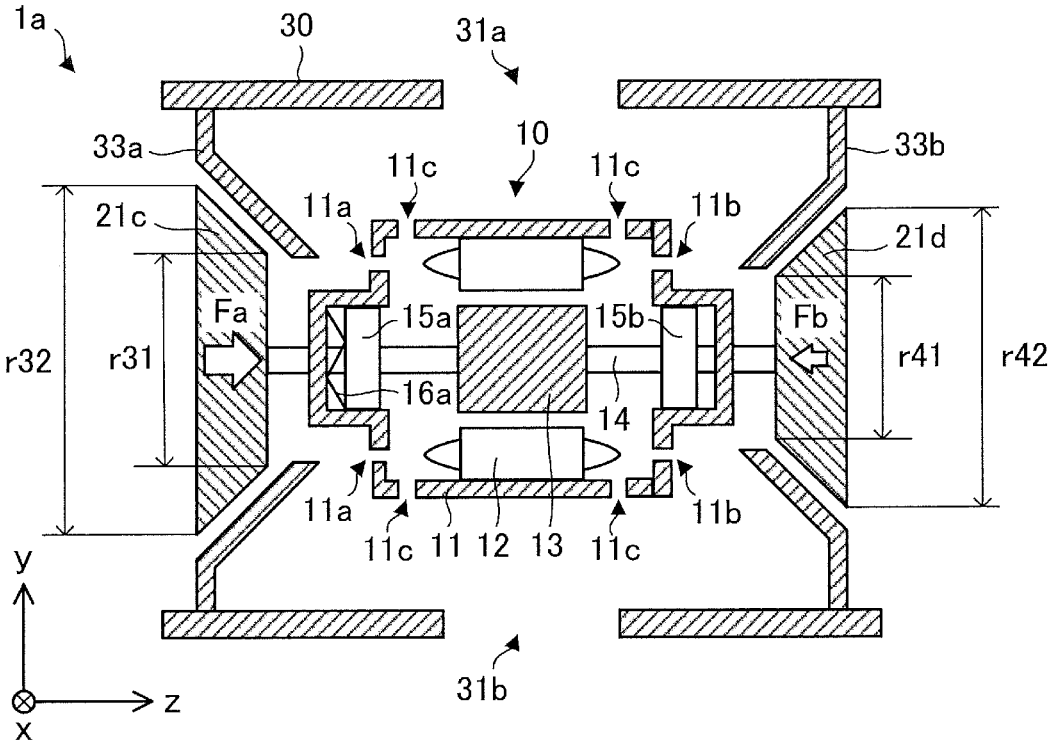
FIG. 9 is a sectional view schematically illustrating a structure of an electric blower according to Modification 1.

FIG. 9 is a sectional view schematically illustrating a structure of an electric blower 1*a* according to Modification 1.

Figure 10:
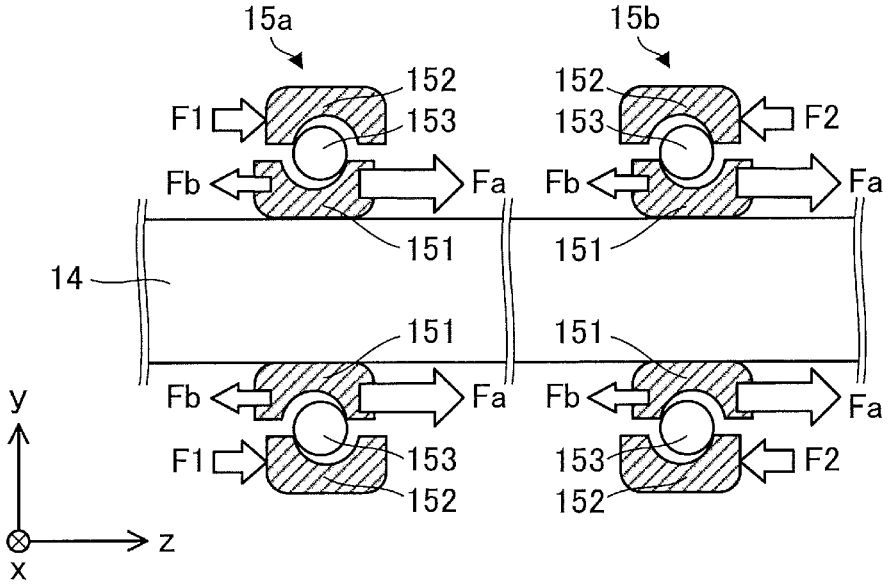
FIG. 10 is a sectional view illustrating a state of bearings in the electric blower according to Modification 1, during driving of a motor.

FIG. 10 is a sectional view illustrating a state of bearings 15*a* and 15*b* in the electric blower 1*a* according to Modification 1, during driving of a motor 10.

The electric blower 1*a* according to Modification 1 is different from the electric blower 1 according to Embodiment 1 in terms of the relationship between the size of a fan 21*c* as a first fan and the size of a fan 21*d* as a second fan.

More specifically, the outer diameter r32 of the fan 21*c* is larger than the outer diameter r42 of the fan 21*d*. In other words, the outer diameter r42 of the fan 21*d* is smaller than the outer diameter r32 of the fan 21*c*. In the electric blower 1*a*, furthermore, the inner diameter r31 of the fan 21*c* is larger than the inner diameter r41 of the fan 21*d*.

In this case, during driving of the motor 10, the thrust Fa and Fb are imbalanced. More specifically, during driving of the motor 10, the thrust Fa is larger than the thrust Fb.

With the electric blower 1*a* according to Modification 1, since the outer diameter r32 of the fan 21*c* is larger than the outer diameter r42 of the fan 21*d*, the thrust Fa is larger than the thrust Fb. Therefore, in the electric blower 1*a*, the load (that is, the force F1) of a preload spring 16*a* can be set low. In other words, the low-load preload spring 16*a* can be used. This makes it possible to maintain certain clearance between balls 153 and an inner ring 151 and certain clearance between the balls 153 and an outer ring 152 with appropriate force, as illustrated in FIG. 10, and to prevent collisions between the balls 153 and the inner ring 151 and collisions between the balls 153 and the outer ring 152. As a result, the lives of the bearings 15*a* and 15*b* can be prolonged.

Adjusting the relationship between the size of the fan 21*c* and that of the fan 21*d* (that is, the relationship between the thrust Fa and the thrust Fb) makes it possible to maintain certain clearance between the balls 153 and the inner ring 151 and certain clearance between the balls 153 and the outer ring 152 with appropriate force (that is, the thrust Fa and Fb), without the preload spring 16*a*. As a result, the cost of parts constituting the electric blower 1*a* can be cut.

Modification 2

Figure 11:
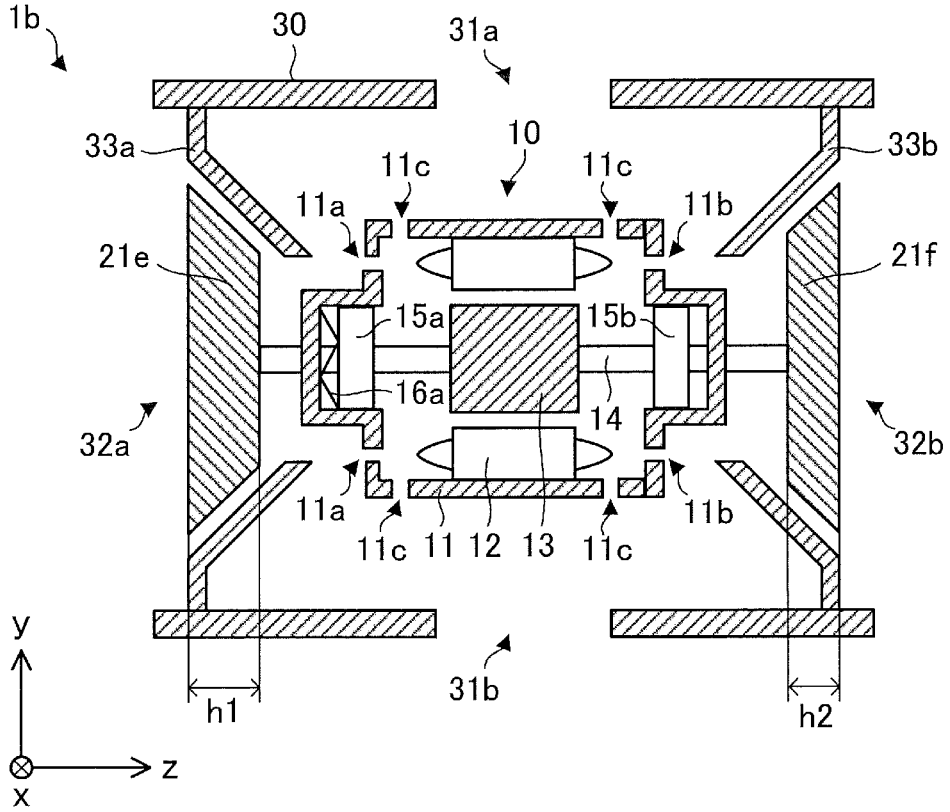
FIG. 11 is a sectional view schematically illustrating a structure of an electric blower according to Modification 2.

FIG. 11 is a sectional view schematically illustrating a structure of an electric blower 1*b* according to Modification 2.

The electric blower 1*b* according to Modification 2 is different from the electric blower 1 according to Embodiment 1 in terms of the relationship between the height h1 of a fan 21*e* as a first fan and the height h2 of a fan 21*f* as a second fan. The heights h1 and h2 are the lengths of the fans 21*e* and 21*f*, respectively, in the axial direction.

In the electric blower 1 according to Embodiment 1, the heights of the fans 21*a* and 21*b* in the axial direction are equal to each other, but in the electric blower 1*b* according to Modification 2, the height h1 of the fan 21*e* is higher than the height h2 of the fan 21*f*. In other words, the height h2 of the fan 21*f* is lower than the height h1 of the fan 21*e*.

With the electric blower 1*b* according to Modification 2, since the height h1 of the fan 21*e* is higher than the height h2 of the fan 21*f*, the thrust Fa is larger than the thrust Fb. Hence, the electric blower 1*b* has the same effect as that of the electric blower 1*a* according to Modification 1. This means that it is possible to maintain certain clearance between balls 153 and an inner ring 151 and certain clearance between the balls 153 and an outer ring 152 with appropriate force, as illustrated in FIG. 10, and to prevent collisions between the balls and the inner ring and collisions between the balls and the outer ring. As a result, the lives of bearings 15*a* and 15*b* can be prolonged.

Modification 3

Figure 12:
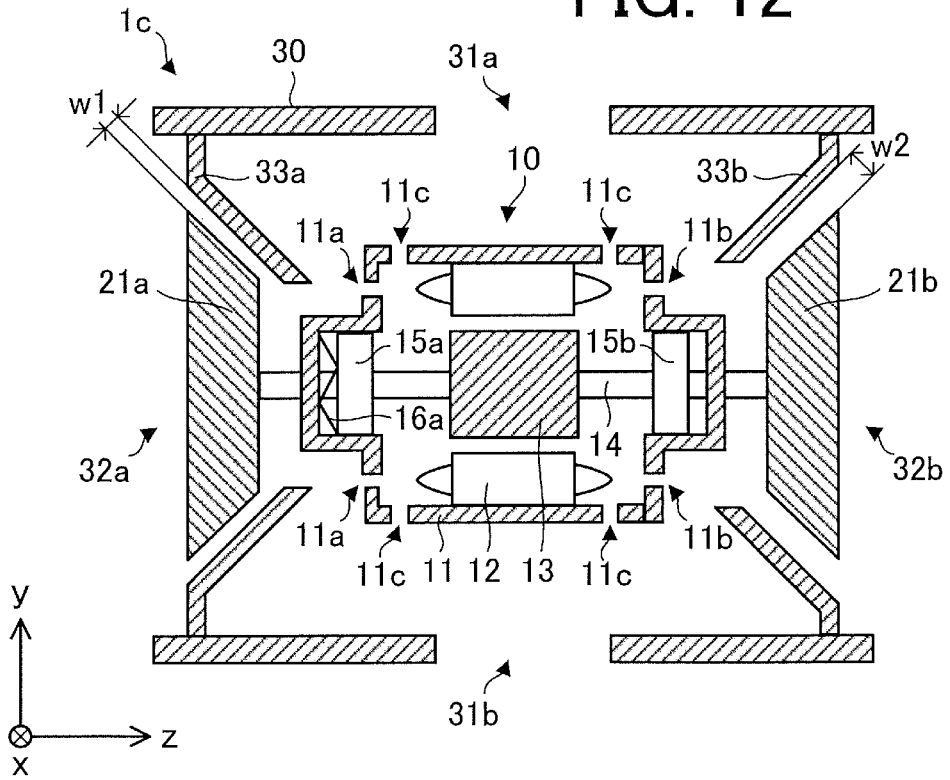
FIG. 12 is a sectional view schematically illustrating a structure of an electric blower according to Modification 3.

FIG. 12 is a sectional view schematically illustrating a structure of an electric blower 1*c* according to Modification 3.

In the electric blower 1 according to Embodiment 1, the width w1 between the fan 21*a* and the fan cover 33*a* and the width w2 between the fan 21*b* and the fan cover 33*b* are equal to each other, but in the electric blower 1*c* according to Modification 3, the width w1 is smaller than the width w2. In other words, the width w2 is larger than the width w1.

With the electric blower 1*c* according to Modification 3, since the width w1 is smaller than the width w2, the thrust Fa is larger than the thrust Fb. Hence, the electric blower 1*c* has the same effect as that of the electric blower 1*a* according to Modification 1. This means that it is possible to maintain certain clearance between balls 153 and an inner ring 151 and certain clearance between the balls 153 and an outer ring 152 with appropriate force, as illustrated in FIG. 10, and to prevent collisions between the balls 153 and the inner ring 151 and collisions between the balls 153 and the outer ring 152. As a result, the lives of bearings 15*a* and 15*b* can be prolonged.

Modification 4

Figure 13:
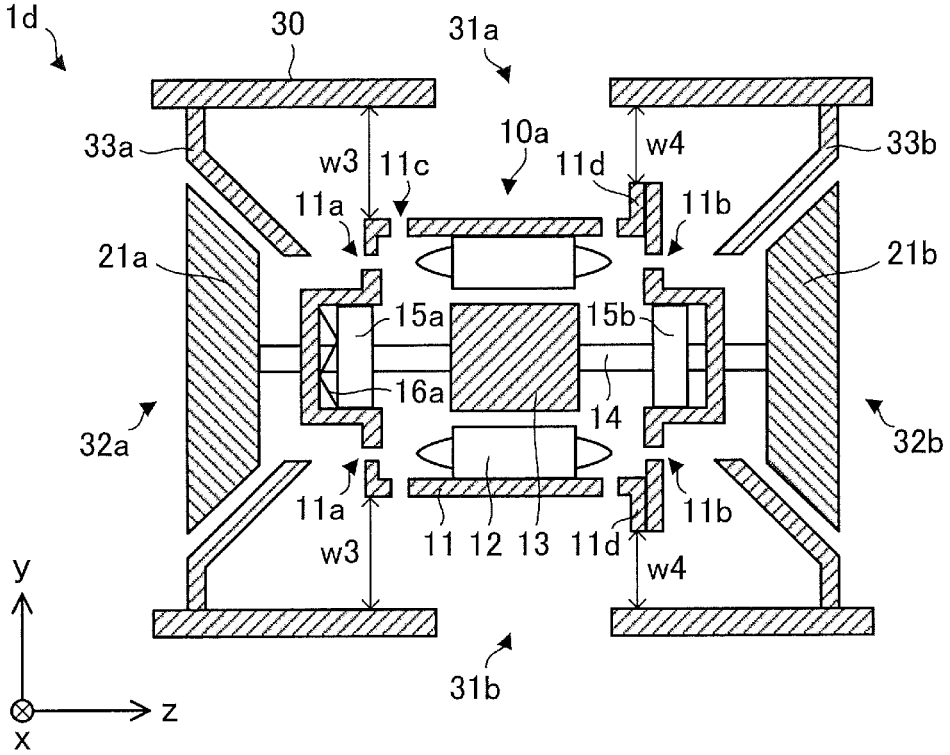
FIG. 13 is a sectional view schematically illustrating a structure of an electric blower according to Modification 4.

FIG. 13 is a sectional view schematically illustrating a structure of an electric blower 1*d* according to Modification 4.

As to the electric blower 1*d* according to Modification 4, the structure of a motor 10*a* is different from that of the electric blower 1 according to Embodiment 1. More specifically, the motor 10*a* includes at least one projecting portion 11*d* projecting from a motor housing 11 in the radial direction. The projecting portion 11*d* is provided on one end side in the axial direction.

In the example illustrated in FIG. 13, the projecting portion 11*d* is formed on the motor housing 11 on the side of a fan 21*b*. With this configuration, the width w3 between the motor 10*a* and a housing 30 on the side of a fan 21*a* is larger than the width w4 between the motor 10*a* (more specifically, the projecting portion 11*d*) and the housing 30 on the side of the fan 21*b*. In other words, the width w4 is smaller than the width w3.

With the electric blower 1*d* according to Modification 4, since the width w3 is larger than w4, the thrust Fa is larger than the thrust Fb. Hence, the electric blower 1*d* has the same effect as that of the electric blower 1*a* according to Modification 1. This means that it is possible to maintain certain clearance between balls 153 and an inner ring 151 and certain clearance between the balls 153 and an outer ring 152 with appropriate force, as illustrated in FIG. 10, and to prevent collisions between the balls 153 and the inner ring 151 and collisions between the balls 153 and the outer ring 152. As a result, the lives of bearings 15*a* and 15*b* can be prolonged.

Modification 5

Figure 14:
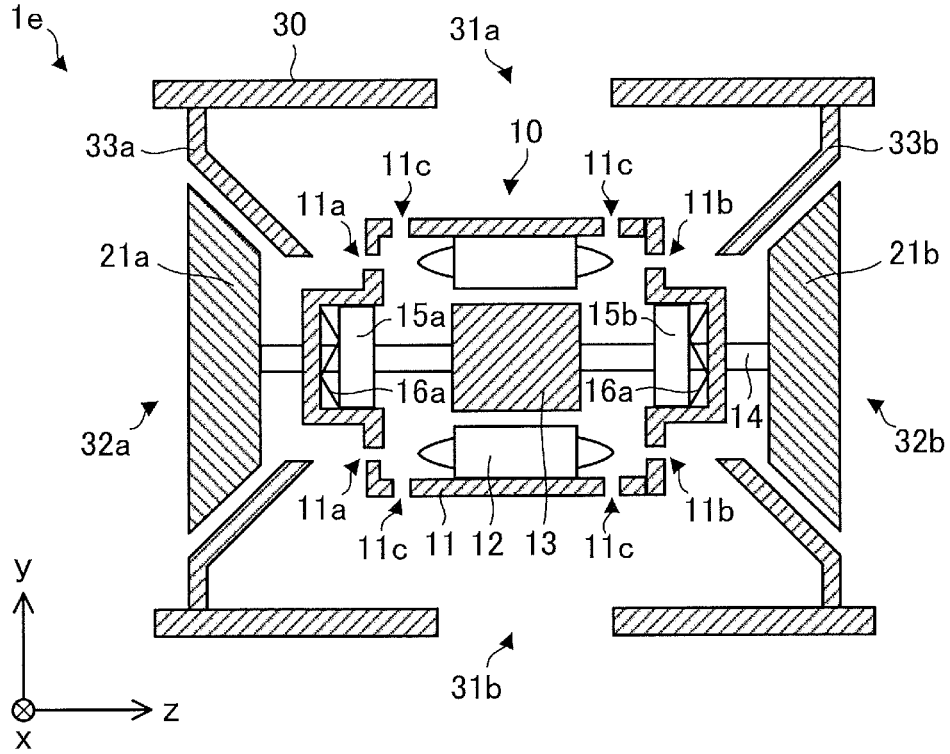
FIG. 14 is a sectional view schematically illustrating a structure of an electric blower according to Modification 5.

FIG. 14 is a sectional view schematically illustrating a structure of an electric blower 1*e* according to Modification 5.

In Embodiment 1, as illustrated in FIG. 1, the preload spring 16*a* is provided on one end side of the motor 10 in the axial direction, but in the electric blower 1*e* according to Modification 5, preload spring 16*a* is provided on each end side of a motor 10 in the axial direction. This makes it possible to facilitate adjustment of the load applied to bearings 15*a* and 15*b*.

Embodiment 2

Figure 15:
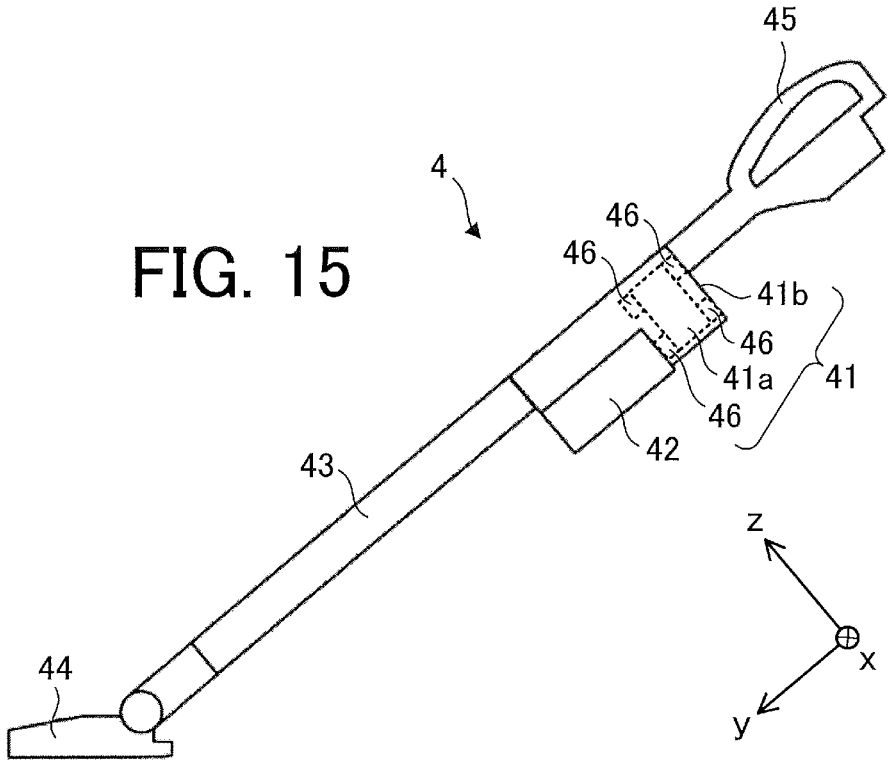
FIG. 15 is a side view schematically illustrating a vacuum cleaner according to Embodiment 2 of the present invention.

FIG. 15 is a side view schematically illustrating a vacuum cleaner 4 (also simply called a "cleaner") according to Embodiment 2 of the present invention.

Figure 16:
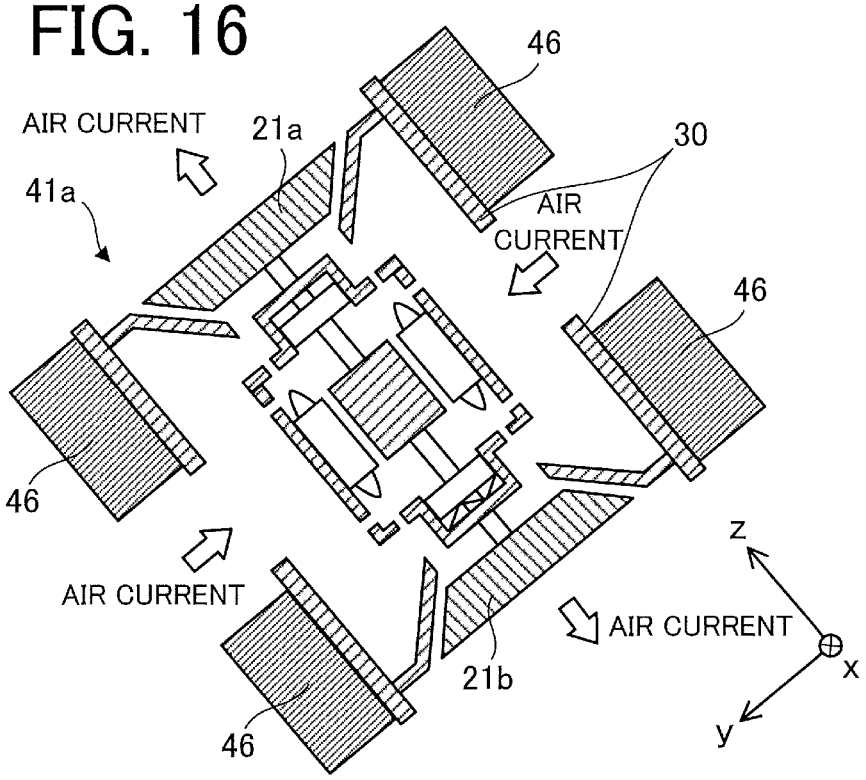
FIG. 16 is a sectional view schematically illustrating a structure of an electric blower and a vibration-proof material mounted on the electric blower.

FIG. 16 is a sectional view schematically illustrating a structure of an electric blower 41*a* and a vibration-proof material 46 mounted on the electric blower 41*a*.

The vacuum cleaner 4 includes a main body 41, a dust chamber 42 (also called a dust collection device), a duct 43, a suction nozzle 44, and a grip portion 45.

The main body 41 includes an electric blower 41*a* to generate suction force (air current), an exhaust port 41*b*, and at least one vibration-proof material 46.

The electric blower 41*a* sends dust to the dust chamber 42 using the suction force. The electric blower 41*a* is identical to the electric blower 1 according to Embodiment 1 (including each Modification).

The dust chamber 42 is mounted on the main body 41. However, the dust chamber 42 may be provided inside the main body 41. The dust chamber 42 is, for example, a container including a filter to separate dust and air. The suction nozzle 44 is mounted at the distal end of the duct 43.

The vibration-proof material 46 is mounted on the exterior of the electric blower 41*a*. The vibration-proof material 46 uses a material capable of absorbing vibration of the electric blower 41*a* to reduce the vibration of the electric blower 41*a*. In the example illustrated in FIGS. 15 and 16, a plurality of vibration-proof materials 46 are mounted on both sides of the housing 30 of the electric blower 41*a* in the axial direction. The positions of the vibration-proof materials 46 are desirably opposite to the fans 21*a* and 21*b* with the housing 30 in between. With this arrangement, even if resonance occurs due to the operations of the fans 21*a* and 21*b*, vibration of the electric blower 41*a* can be efficiently reduced.

When the vacuum cleaner 4 is powered on, power is supplied to the electric blower 41*a* and thus the electric blower 41*a* is driven. During driving of the electric blower 41*a*, dust is sucked up from the suction nozzle 44 by the suction force generated by the electric blower 41*a*. In this Embodiment, since the vacuum cleaner 4 includes an electric blower 41*a* equipped with two fans (that is, the fans 21*a* and 21*b*), air currents generated by rotation of the two fans are combined together in the suction nozzle 44 and the duct 43. The dust sucked up from the suction nozzle 44 by suction is collected in the dust chamber 42 through the duct 43. The air sucked up from the suction nozzle 44 by suction is exhausted outside the vacuum cleaner 4 from the exhaust port 41*b* through the electric blower 41*a*.

The vacuum cleaner 4 according to Embodiment 2 includes the electric blower 1 described in Embodiment 1 (including each Modification), and therefore has the same effect as that described in Embodiment 1.

With the vacuum cleaner 4 according to Embodiment 2, shortening of the life of the electric blower 41*a* can be prevented and consequently shortening of the life of the vacuum cleaner 4 can be prevented.

With the vacuum cleaner 4 according to Embodiment 2, furthermore, the aerodynamic efficiency of the electric blower 41*a* can be enhanced and consequently the aerodynamic efficiency of the vacuum cleaner 4 can be enhanced.

Since the vacuum cleaner 4 uses a combined air current generated by two fans (that is, the fans 21*a* and 21*b*), the suction force can be strengthened.

Compared to an electric blower equipped with only one fan, the load of the electric blower 41*a* is reduced, and the outer diameter of each fan (that is, the fans 21*a* and 21*b*) can thus be set smaller.

Embodiment 3

Figure 17:
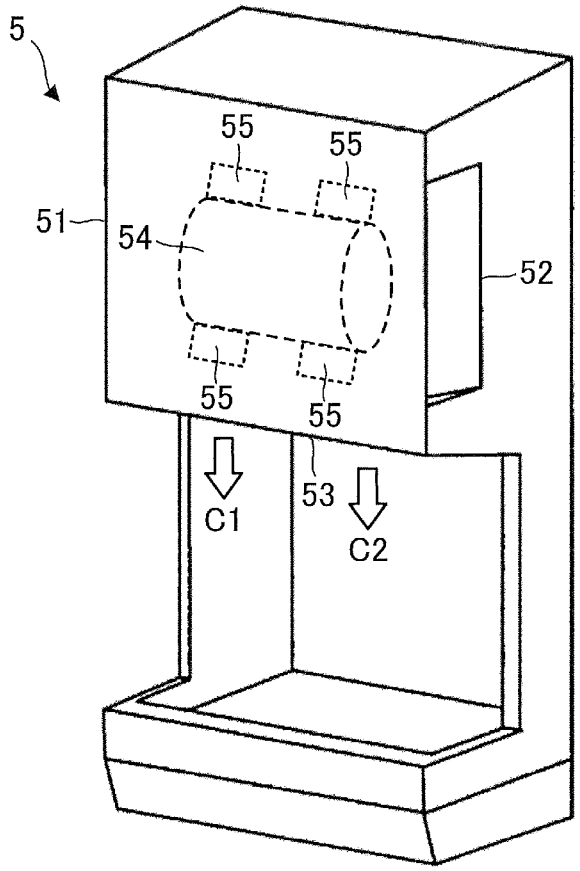
FIG. 17 is a perspective view schematically illustrating a hand dryer as a hand drying device according to Embodiment 3 of the present invention.

FIG. 17 is a perspective view schematically illustrating a hand dryer 5 as a hand drying device according to Embodiment 3 of the present invention.

Figure 18:
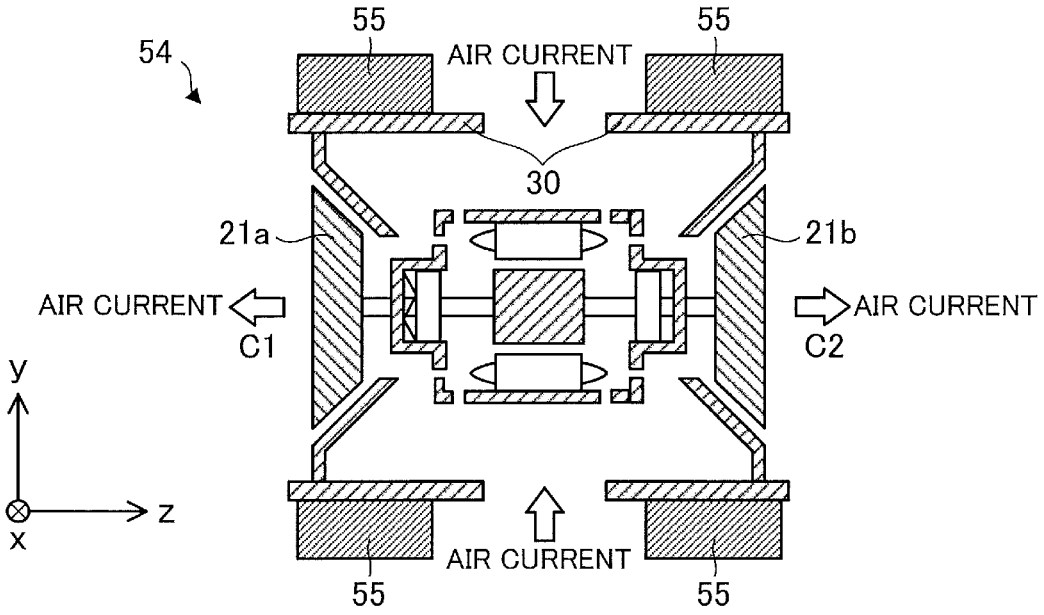
FIG. 18 is a sectional view schematically illustrating a structure of an electric blower and a vibration-proof material mounted on the electric blower.

FIG. 18 is a sectional view schematically illustrating a structure of an electric blower 54 and a vibration-proof material 55 mounted on the electric blower 54.

The hand dryer 5 serving as a hand drying device includes a housing 51 (in this Embodiment, a first housing), the electric blower 54, and at least one vibration-proof material 55. The housing 51 includes at least one air inlet 52 and at least one air outlet 53. The electric blower 54 is fixed in the housing 51.

The electric blower 54 is identical to the electric blower 1 according to Embodiment 1 (including each Modification). The electric blower 54 performs air suction and blowing by generating an air current. More specifically, the electric blower 54 sucks up air exterior to the housing 51 through the air inlet 52 and sends the air out of the housing 51 through the air outlet 53.

The vibration-proof material 55 is mounted on the exterior of the electric blower 54. The vibration-proof material 55 uses a material capable of absorbing vibration of the electric blower 54 to reduce the vibration of the electric blower 54. In the example illustrated in FIGS. 17 and 18, a plurality of vibration-proof materials 55 are mounted on both sides of the housing 30 (in this Embodiment, a second housing) of the electric blower 54 in the axial direction. The positions of the vibration-proof materials 55 are desirably opposite to the fans 21*a* and 21*b* with the housing 30 in between. With this arrangement, even if resonance occurs due to the operations of the fans 21*a* and 21*b*, vibration of the electric blower 54 can be efficiently reduced.

When the hand dryer 5 is powered on, power is supplied to the electric blower 54 and thus the electric blower 54 is driven. During driving of the electric blower 54, air exterior to the hand dryer 5 is sucked up from the air inlet 52. The air sucked up from the air inlet 52 passes through the inside of the electric blower 54 and then is exhausted from the air outlet 53.

In this Embodiment, since the hand dryer 5 includes the electric blower 54 equipped with two fans (that is, the fans 21*a* and 21*b*), two air currents (more specifically, air currents C1 and C2) can be exhausted from the air outlet 53. Note, however, that the two air currents generated by the electric blower 54 may be combined into one air current. In this case, one combined air current is exhausted from the air outlet 53.

In the example illustrated in FIG. 17, the air current C1 is generated by the fan 21*a*, and the air current C2 is generated by the fan 21*b*. When a user of the hand dryer 5 puts his or her hand near the air outlet 53, droplets of water on the hand can be blow away and the hand can be dried.

The hand dryer 5 according to Embodiment 3 includes the electric blower 1 described in Embodiment 1 (including each Modification), and therefore has the same effect as that described in Embodiment 1.

In addition, with the hand dryer 5 according to Embodiment 3, shortening of the life of the electric blower 54 can be prevented and consequently shortening of the life of the hand dryer 5 can be prevented.

In addition, with the hand dryer 5 according to Embodiment 3, furthermore, the aerodynamic efficiency of the electric blower 54 can be enhanced and consequently the aerodynamic efficiency of the hand dryer 5 can be enhanced.

In addition, with the hand dryer 5 according to Embodiment 3, an air current generated by one fan can be assigned to one hand. It is possible, for example, to dry the left hand by the air current C1 and dry the right hand by the air current C2. This makes it possible to reduce the load of the electric blower 54 to efficiently dry both hands of the user.

In addition, compared to an electric blower equipped with only one fan, the load of the electric blower 54 is reduced, and the outer diameter of each fan (that is, the fans 21*a* and 21*b*) can thus be set smaller.

The features in the above-described respective embodiments can be combined with each other as appropriate.

What is claimed is:

1. An electric blower comprising:

a motor;

a first fan provided on one end side of the motor in an axial direction and to generate a first air current;

a second fan provided opposite to the first fan in the axial direction and to generate a second air current; and a housing covering the motor, the first fan, and the second fan, wherein the housing includes a first exhaust port and a second exhaust port that are formed on both sides in the axial direction, and the first air current and the second air current are exhausted from the first exhaust port and the second exhaust port to an area outside of the electric blower in opposite directions to each other in the axial direction respectively.

2. The electric blower according to claim 1, wherein a diameter of an inner end of the first fan in the axial direction is smaller than a diameter of an outer end of the first fan in the axial direction.

3. The electric blower according to claim 1, wherein a diameter of an inner end of the second fan in the axial direction is smaller than a diameter of an outer end of the second fan in the axial direction.

4. The electric blower according to claim 1, wherein the housing includes a suction port formed between the first fan and the second fan in the axial direction.

5. The electric blower according to claim 1, wherein the motor includes a rotor to rotate the first fan and the second fan.

6. The electric blower according to claim 5, wherein the motor includes a shaft fixed to the rotor, a bearing to rotatably support the shaft, and a preload spring to apply a load in the axial direction to the bearing.

7. The electric blower according to claim 5, wherein the motor includes a motor housing covering the rotor, and the motor housing includes a hole passing through the motor housing in a radial direction of the motor.

8. The electric blower according to claim 7, wherein the motor includes a projecting portion provided on one end side in the axial direction and projecting from the motor housing in the radial direction of the motor.

9. The electric blower according to claim 1, wherein a diameter of an outer end of the first fan in the axial direction is larger than a diameter of an outer end of the second fan in the axial direction.

10. The electric blower according to claim 1, wherein a height of the first fan in the axial direction is higher than a height of the second fan in the axial direction.

11. The electric blower according to claim 1, wherein the housing includes:

a first fan cover covering the first fan; and a second fan cover covering the second fan, and a width between the first fan and the first fan cover is smaller than a width between the second fan and the second fan cover.

* * * * *